US007771217B2

(12) United States Patent
Bethurum et al.

(10) Patent No.: US 7,771,217 B2
(45) **Date of Patent: *Aug. 10, 2010**

(54) ELECTRICAL DISCONNECT WITH PUSH-IN CONNECTORS

(75) Inventors: Gary Bethurum, Murrieta, CA (US); Benjamin Swedberg, Sycamore, IL (US); Robert Sutter, DeKalb, IL (US)

(73) Assignee: IDEAL Industries, Inc., Sycamore, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/434,291

(22) Filed: May 1, 2009

(65) Prior Publication Data

US 2009/0227132 A1 Sep. 10, 2009

Related U.S. Application Data

(60) Continuation of application No. 11/876,438, filed on Oct. 22, 2007, now Pat. No. 7,527,509, which is a division of application No. 11/425,427, filed on Jun. 21, 2006, now abandoned.

(60) Provisional application No. 60/692,631, filed on Jun. 21, 2005, provisional application No. 60/741,222, filed on Dec. 1, 2005.

(51) Int. Cl.
*H01R 13/62* (2006.01)

(52) U.S. Cl. ..... 439/153; 439/752

(58) Field of Classification Search ..... 439/752, 439/153

See application file for complete search history.

(56) References Cited

U.S. PATENT DOCUMENTS 2,384,267 A 9/1945 Andersen
2,386,177 A 10/1945 Andersen
2,720,634 A 10/1955 Hart
2,838,739 A 6/1958 Winkler
3,093,433 A 6/1963 Ege
3,208,030 A 9/1965 Evans et al.
3,324,447 A 6/1967 Pistey
3,337,836 A 8/1967 Churla, Jr.
3,827,007 A 7/1974 Fairbairn et al.
3,945,711 A 3/1976 Hohorst et al.
4,186,988 A 2/1980 Kobler
4,295,184 A 10/1981 Roberts
4,370,013 A 1/1983 Niitsu et al.
4,397,514 A 8/1983 Durand et al.
4,431,244 A 2/1984 Anhalt et al.

(Continued)

FOREIGN PATENT DOCUMENTS

DE 29623742 U1 11/1999

(Continued)

*Primary Examiner*—Briggitte R Hammond
(74) *Attorney, Agent, or Firm*—Cook Alex Ltd.

(57) ABSTRACT

An electrical disconnect has first and second female contacts mounted in a power connector housing and first and second male contacts in a load connector housing. The male contacts each have a male blade contact finger. The female contacts each have a socket for removably receiving a male blade contact finger. At the rear ends of both the male and female contacts there are integrally formed push-in connector elements for receiving a conductor or wire. The disconnect is particularly suited for use in connecting power wires to a load device in a circuit, such as a fluorescent light ballast.

6 Claims, 13 Drawing Sheets

U.S. PATENT DOCUMENTS 4,537,456 A 8/1985 Brown et al.
4,552,425 A 11/1985 Billman
4,566,748 A 1/1986 Tanishi et al.
4,566,749 A 1/1986 Johnston
4,659,158 A 4/1987 Sakamoto et al.
4,673,232 A 6/1987 Kubota
4,818,237 A 4/1989 Weber
4,824,395 A 4/1989 Blaha
4,952,167 A 8/1990 Hertelendy
4,963,102 A 10/1990 Gettig et al.
4,973,263 A 11/1990 Nielsen
4,978,316 A 12/1990 Yahata
4,979,910 A 12/1990 Revil et al.
4,993,967 A 2/1991 Matsumoto
5,137,466 A 8/1992 Endo et al.
5,164,545 A 11/1992 Krienberg et al.
5,167,528 A 12/1992 Nishiyama et al.
5,234,356 A 8/1993 Maejima et al.
5,238,427 A 8/1993 Fry et al.
5,314,347 A 5/1994 Colleran et al.
5,342,221 A 8/1994 Peterson
5,342,226 A 8/1994 Hayes et al.
5,350,316 A 9/1994 Van Wagener et al.
5,409,395 A 4/1995 Okada
5,454,730 A 10/1995 Tozuka
5,463,540 A 10/1995 Jones
5,488,268 A 1/1996 Bauer et al.
5,575,678 A 11/1996 Okumura et al.
5,605,472 A 2/1997 Sakai et al.
5,613,881 A 3/1997 Ichida et al.
5,624,271 A 4/1997 Childs et al.
5,632,645 A 5/1997 Love
5,769,672 A 6/1998 Flieger
5,788,527 A 8/1998 Sanders et al.
5,797,772 A 8/1998 Sakurai et al.
5,895,286 A 4/1999 Linke
5,934,946 A 8/1999 Nakamura
5,975,940 A 11/1999 Hartmann et al.
5,997,334 A 12/1999 Goto
5,997,366 A 12/1999 Libregts
6,039,597 A 3/2000 Getselis et al.
6,039,615 A 3/2000 Suzuki
6,065,987 A 5/2000 Bigotto
6,074,242 A 6/2000 Stefaniu et al.
6,083,057 A 7/2000 Annecke et al.
6,093,059 A 7/2000 Bogese
6,128,181 A 10/2000 Higami
6,132,233 A 10/2000 Fukuda
6,200,168 B1 3/2001 Ko
6,254,422 B1 7/2001 Feye-Hohmann
6,257,919 B1 7/2001 Cutler et al.
6,280,233 B1 8/2001 Beege et al.
6,293,831 B1 9/2001 Yamatani
6,336,824 B1 1/2002 Sorig
6,514,098 B2 2/2003 Marpoe, Jr. et al.
6,540,529 B1 4/2003 Yu
6,570,306 B2 5/2003 Henrici et al.
6,589,082 B2 7/2003 Harasawa et al.
6,652,303 B2 11/2003 Stockel et al.
6,746,286 B2 6/2004 Blaha
6,783,385 B2 8/2004 Rudy
6,832,938 B2 12/2004 Lenker
6,846,188 B2 1/2005 Hsin et al.
6,913,494 B2 7/2005 Ward et al.
7,210,970 B1 5/2007 Pellon et al.
7,255,592 B1 8/2007 Tseng
7,278,890 B1 10/2007 Smutny et al.
7,281,942 B2 10/2007 Swedberg et al.
7,287,999 B2 10/2007 Holterhoff et al.
7,470,143 B2 12/2008 Osborn et al.
7,488,196 B2 2/2009 Kocher et al.
7,497,721 B2 3/2009 Lauermann et al.
2003/0017747 A1 1/2003 Blanchfield et al.
2004/0157476 A1 8/2004 Maldonado et al.
2005/0042901 A1 2/2005 Minich et al.
2005/0104524 A1 5/2005 Bishop
2005/0164552 A1 7/2005 Wlos et al.
2006/0063419 A1 3/2006 Steinkemper et al.
2006/0217003 A1 9/2006 Martin et al.
2006/0286864 A1 12/2006 Bethurum et al.
2007/0099480 A1 5/2007 Fabian et al.
2007/0249215 A1 10/2007 Osborn et al.
2008/0020628 A1 1/2008 Kikuchi

FOREIGN PATENT DOCUMENTS

DE 29920231 U1 4/2001
GB 2294817 A 5/1996

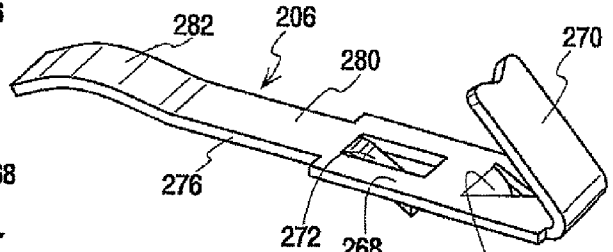
Fig. 33
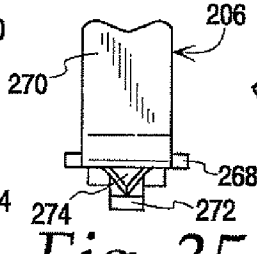
Fig. 35
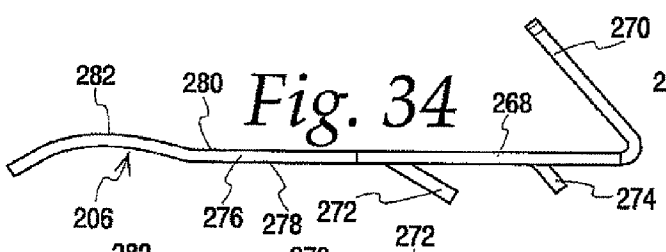
Fig. 34
Fig. 36
Fig. 37
Fig. 39
Fig. 38
Fig. 40

ELECTRICAL DISCONNECT WITH PUSH-IN CONNECTORS

CROSS-REFERENCES TO RELATED APPLICATIONS

This application is a continuation of application Ser. No. 11/876,438, filed Oct. 22, 2007, which issued as U.S. Pat. No. 7,527,509 on May 5, 2009, and which is a divisional of Ser. No. 11/425,427, filed Jun. 21, 2006 now abandoned which claims the benefit of U.S. application Ser. No. 60/692,631, filed Jun. 21, 2005 and U.S. application Ser. No. 60/741,222, filed Dec. 1, 2005, and all four applications are incorporated by reference herein.

BACKGROUND OF THE INVENTION

This invention concerns a disconnect for electrical circuits. It incorporates a plug and socket combination that provides a convenient and safe way to replace circuit elements in live circuits. A common, but by no means exclusive, application for the disconnect is in non-residential fluorescent light fixtures. Such fixtures require a ballast to operate. Ballasts are typically hard-wired between the power supply and the fluorescent tubes. When a ballast fails it has to be replaced. Traditionally this has been performed by an electrician who cuts the wires to the failed ballast and removes the old ballast. The electrician then installs a new ballast, strips the wire ends, and connects the new ballast's wires to the power supply and tube sockets using suitable twist-on connectors such as those sold by IDEAL Industries, Inc. under their trademarks WIRE-NUT® and TWISTER®. Often this is done in offices, factories, commercial, retail spaces or other facilities where shutting down the power to the fixture is not a practical option. Thus, ballasts are frequently replaced in live circuits. This leaves no room for error on the part of the electrician. Unfortunately, electricians occasionally do make errors which result in personal injury and/or property damage.

The National Electrical Code (NEC) section 410.73(G) addresses the problem of replacing ballasts for non-residential fluorescent fixtures in live circuits. It requires a disconnect that simultaneously removes all conductors of the ballast from the source of supply. It also states that the line side terminals of the disconnect shall be guarded.

The available technology for meeting the NEC requirements includes pin and socket connectors. While such connectors meet the basic requirements they have several disadvantages. They are not rated for solid wire. They require crimping by the electrician. The labor costs of crimping and assembling the connectors is high and the cost of the connectors themselves is high. Insulated terminals provide the lowest cost option but these fail to meet the code requirements of simultaneous disconnect of all wires. Furthermore, insulated terminals are not rated for solid wire and they require crimping by the electrician with its attendant labor cost.

What is needed is a disconnect that fully meets the NEC code requirements but does not add labor cost at the factory or in the field. The technology should be familiar to factory personnel as well as electricians, with no special tools required by either. The disconnect should work with either solid or stranded wire and it should minimize the total installed cost.

SUMMARY OF THE INVENTION

The present invention is an electrical disconnect having push-in connectors. The disconnect meets the objectives previously set forth. The disconnect can be used in any electrical circuit where quick, convenient and replaceable connections to the circuit are desirable. It is particularly suited for use in connecting fluorescent light ballasts, although it could be used in a wide variety of other applications as well.

The disconnect in this embodiment has at least first and second female contacts mounted in a power connector housing and mating first and second male contacts in a ballast connector housing. The numbers of contacts could be different. Some applications may require only a single contact, others may require more than two contacts. In one embodiment, the forward ends of the male contacts each have a male blade contact finger. At a forward end the female contacts each have a socket for removably receiving a male blade contact finger. At the rear ends of both the male and female contacts there are integrally formed push-in connector elements for receiving a conductor or wire. In the case of the power connector contacts these wires are from the power supply. In the case of the ballast connector contacts these wires are from the ballast. The housings may have a mating hook and latch that releasably hold the housings together when joined. The hook is formed on a flexible tab that can be depressed to release the hook and permit separation of the housings.

The contacts in one or both of the housings may each be formed with first and second spring fingers. This construction permits attachment of two separate wires to the contact. This in turn permits multiple fixtures to be attached to a single disconnect or multiple disconnects to be attached to a single power supply. Either way the effect may be referred to as a daisy chain.

The invention further contemplates a retainer plate built into the housing for holding push-in contacts in the housing. With a built-in retainer plate the housing may be a single piece rather than requiring a separate retainer to hold the contacts in place.

Another aspect of the invention is a particular design of the push-in contact elements that will allow the contact to work reliably with a range of wire sizes and types.

Yet another aspect of the invention is a disconnect with push-in contacts arranged in a side-by-side relation where the contacts have support rails to prevent them from flexing away from one another to an extent that would degrade the electrical engagement between them. The housings are arranged so that even with support rails behind the support surface of each contact, the male portion of one housing is received with the female portion of the other housing.

BRIEF DESCRIPTION OF THE DRAWING

FIG. 33 is a perspective view of the male contact.

FIG. 34 is a side elevation view of the male contact.

FIG. 35 is an end elevation view of the male contact.

FIG. 36 is a bottom plan view of the male contact.

FIG. 37 is a perspective view of the female contact.

FIG. 38 is a side elevation view of the female contact.

FIG. 39 is an end elevation view of the female contact.

FIG. 40 is a bottom plan view of the female contact.

DETAILED DESCRIPTION OF THE INVENTION

Figure 1:
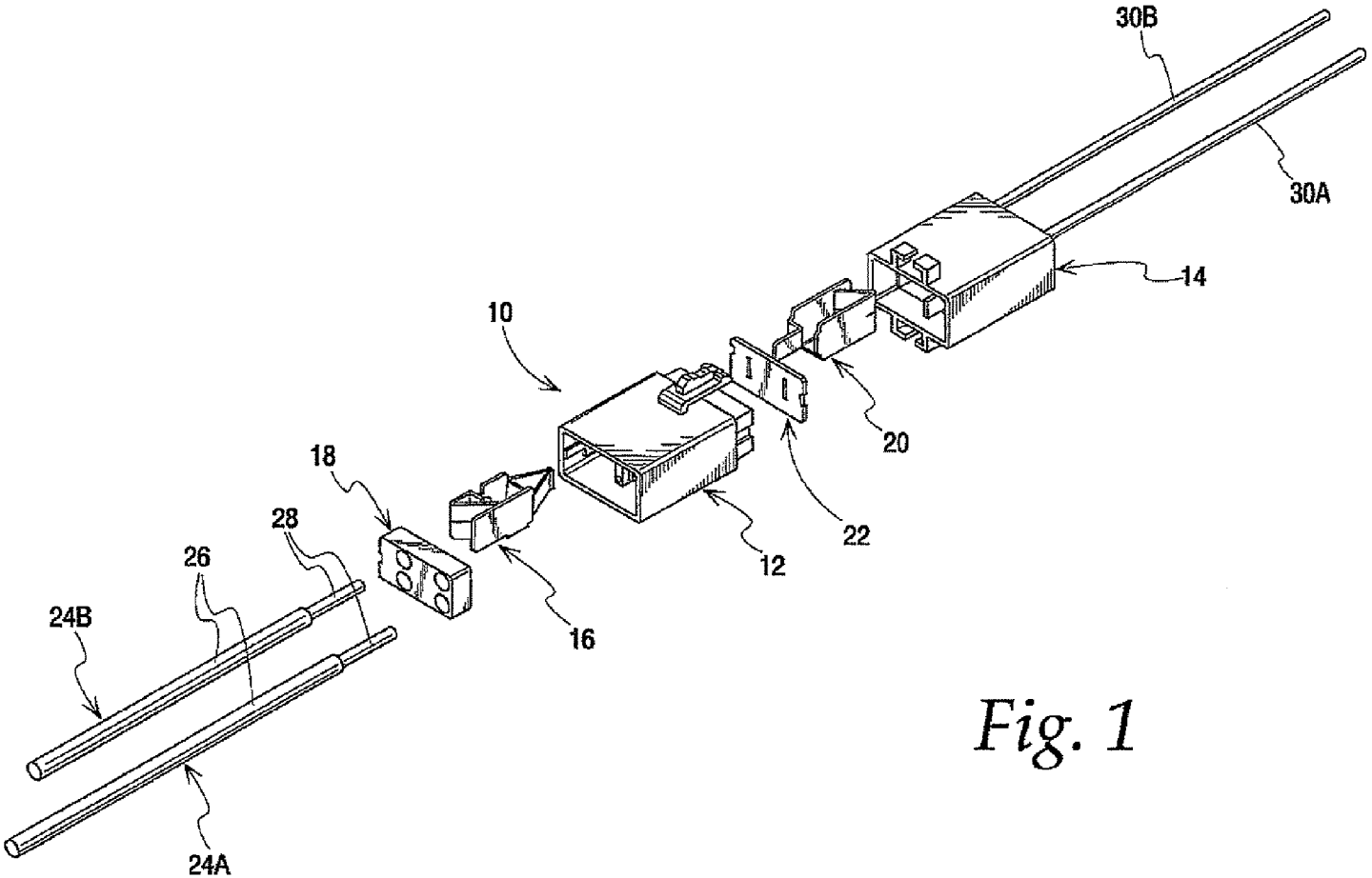
FIG. 1 is an exploded perspective view of a first embodiment of the disconnect of the present invention.

A first embodiment of the disconnect assembly of the present invention is shown generally at 10 in FIG. 1. The disconnect includes a power connector housing 12 and a load connector housing 14. Details of these housings will be described below. While the following description is in some ways directed to the ballast application, it should be emphasized that this is for description purposes only and is not intended to limit the invention or this disclosure in any way. It will be readily understood that the disconnect can be used for connecting and disconnecting any type of circuit element, not just fluorescent light ballasts. Further, it will be readily appreciated by those skilled in the art that the circuit element to which a connector housing is attached could be reversed from that shown. That is, the power connector housing 12 could be connected to the load while the load connector housing 14 could be connected to the power supply. Thus it will be understood that references herein to the power connector housing or load connector housing are for reference purposes only and are not to be interpreted as limiting where the connectors are used or how they are connected in a particular circuit.

Inside the power connector housing 12 there are a pair of female contacts, one of which is shown at 16. The female contacts are fixed in individual compartments in the housing 12 by a power connector retainer 18. Inside the load connector housing 14 there are a pair of male contacts, one of which is shown at 20. The male contacts are fixed in individual compartments in housing 14 by a load connector retainer 22. Each of the male and female contacts 16, 20 includes push-in connector elements integrally formed at the rear portions thereof as will be described. Wires from the power supply are shown at 24A, 24B. These could be 12/14 AWG solid or stranded wire. The insulation of the wire is shown at 26 and a stripped or exposed conductor portion is shown at 28. The load wires 30A, 30B extend to the load device, e.g., a ballast (not shown). These wires may typically be 18 AWG solid wire.

Figure 2:
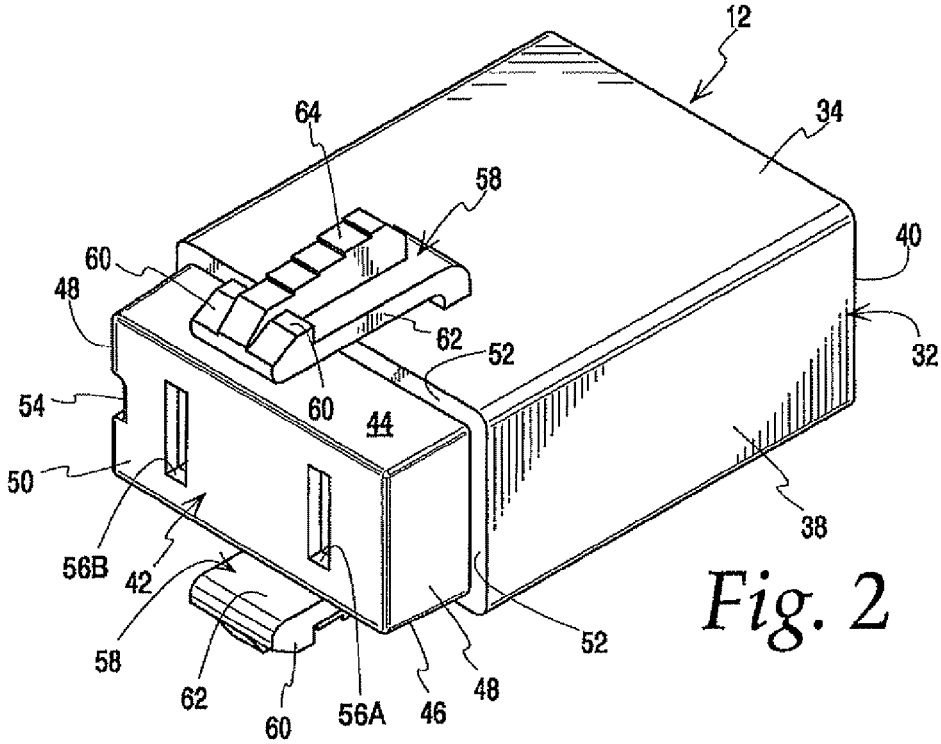
FIG. 2 is a perspective view of the power connector housing, looking at the front end of the housing.

Looking at FIG. 2, details of the exterior of the power connector housing 12 are shown. The housing has a generally rectangular shell 32 defined by a top wall 34 and a bottom wall 36. The top and bottom walls are connected by two side walls 38. The shell has an open rear end at 40. The front end of the shell has a five-sided extension 42 defined by its own top wall 44, bottom wall 46, side walls 48 and end wall 50. The interior of the extension is open to and joins the interior of the main shell. The dimensions of the extension walls are slightly reduced compared to the main shell such that the front ends of the walls 34, 36, 38 form an abutment 52. One of the side walls 48 of the extension has a keyway 54. The end wall 50 has two access openings 56A, 56B.

Latch bars 58 overlie the top and bottom walls of both the shell 32 and extension 42. Each latch bar includes a pair of catches 60 mounted on a flexible arm 62. The arms are mounted in cantilevered fashion on the top or bottom walls of the shell. A ramp surface 64 lies between the hooks 60 and provides a convenient point of contact for a user's finger to depress the arm.

Figure 3:
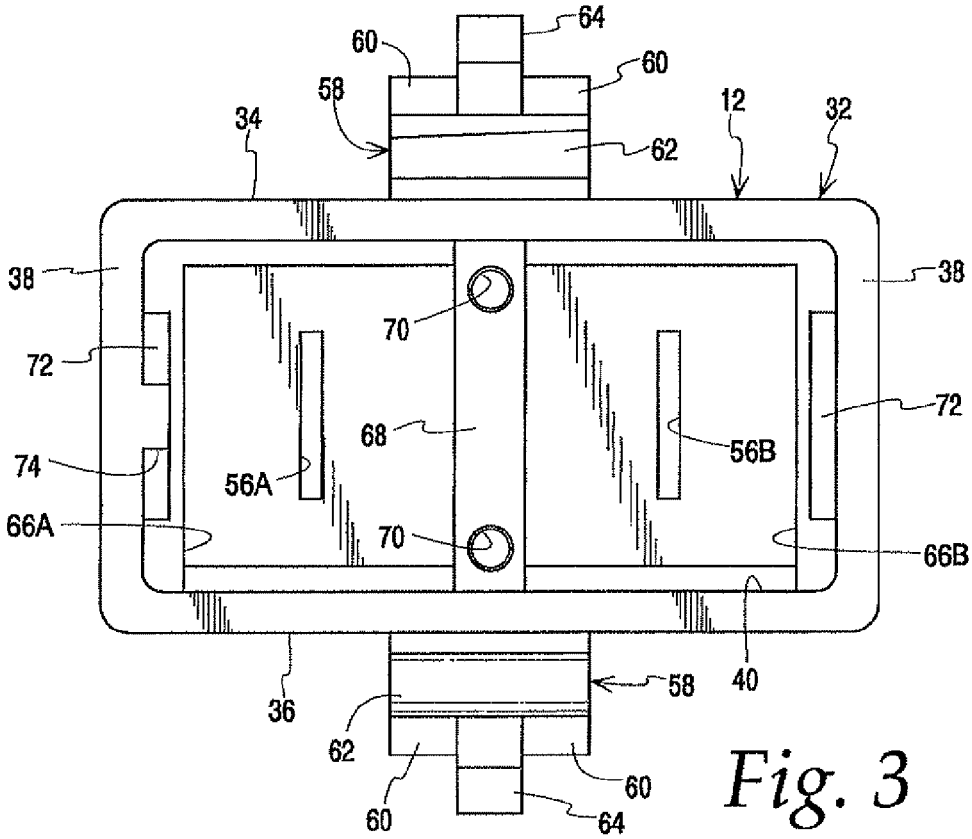
FIG. 3 is a rear end elevation view of the power connector housing.

FIG. 3 is a view looking into the open end 40 of the power connector housing 12 to illustrate the features of the interior thereof. The interior is divided into two compartments 66A, 66B by a partition 68. The rear end face of the partition has two seats 70. The inner surfaces of the side walls 38 carry barrier pads 72. A polarizing rail 74 extends rearwardly from one of the pads 72 to the open end 40.

Figure 4:
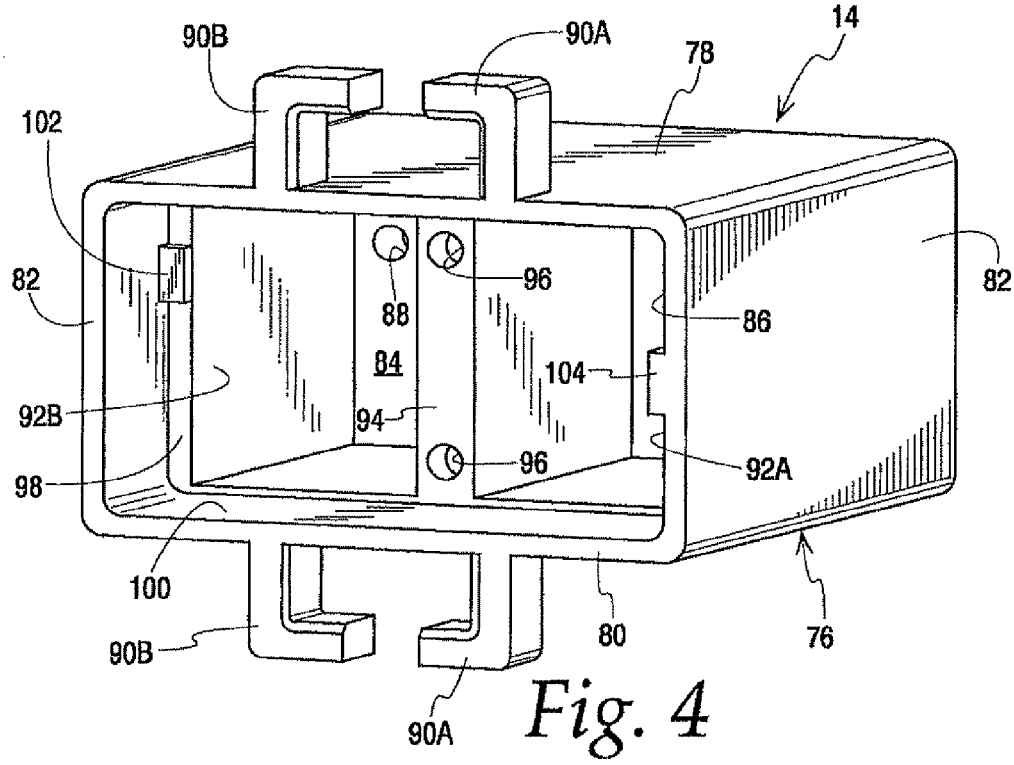
FIG. 4 is a perspective view of the ballast connector housing, looking at the front end of the housing.
Figure 5:
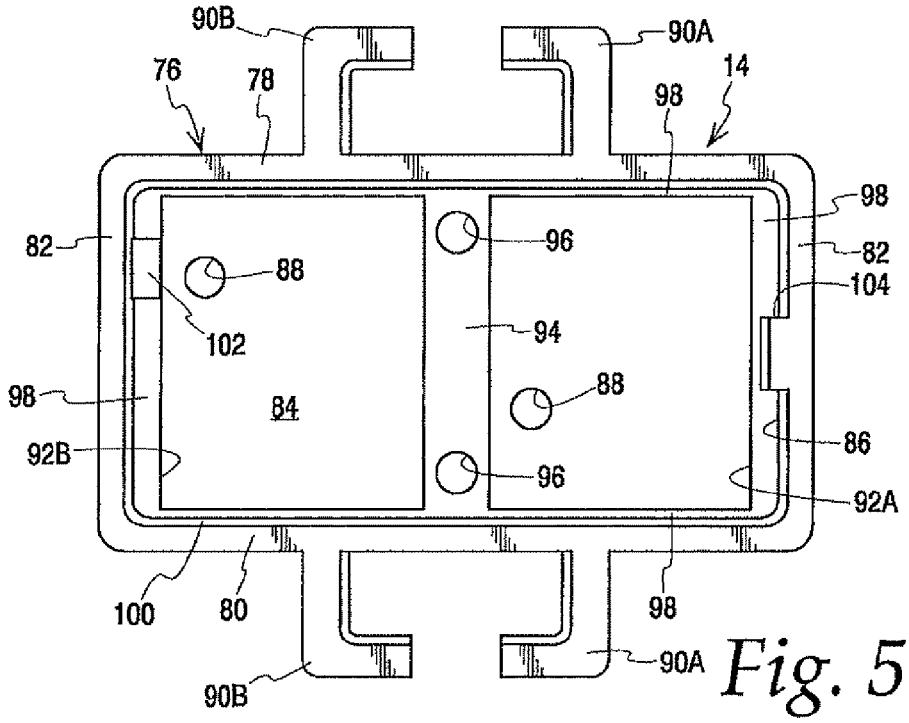
FIG. 5 is a front end elevation view of the ballast connector housing.

Details of the load connector housing 14 are shown in FIGS. 4 and 5. It has a rectangular shell 76 similar to that of the power connector housing. Shell 76 includes top wall 78, bottom wall 80, side walls 82 and end wall 84. In this case the end wall 84 is at the rear of the housing, instead of at the front as with the power connector housing 12. This leaves an open front end 86 in the housing. The end wall has at least two apertures 88 through it for receiving the load wires. Both the top and bottom walls mount pairs of facing hooks 90A, 90B. The hooks are sized and spaced to receive the ramp surface 64 between them and the catches 60 underneath them when the housings 12 and 14 are joined together.

As is the case with the power connector housing, the interior of the load connector housing is divided into two compartments 92A, 92B by a partition 94. The forward end face of the partition has two seats 96 cut into it. The partition extends forwardly from the end wall 84 but terminates short of the open end 86. The partition ends at a point where it is even with abutments 98 formed on the inner surfaces of the top, bottom and side walls 78, 80 and 82. The abutments are formed by the end faces of portions of increased wall thickness. The abutments define a recess 100 at the front of the shell 76. One of the abutments 98 carries a small orienting block 102. A key 104 adjoins the abutment on the opposite side wall 82 and extends all the way to the front open end 86.

Figure 6:
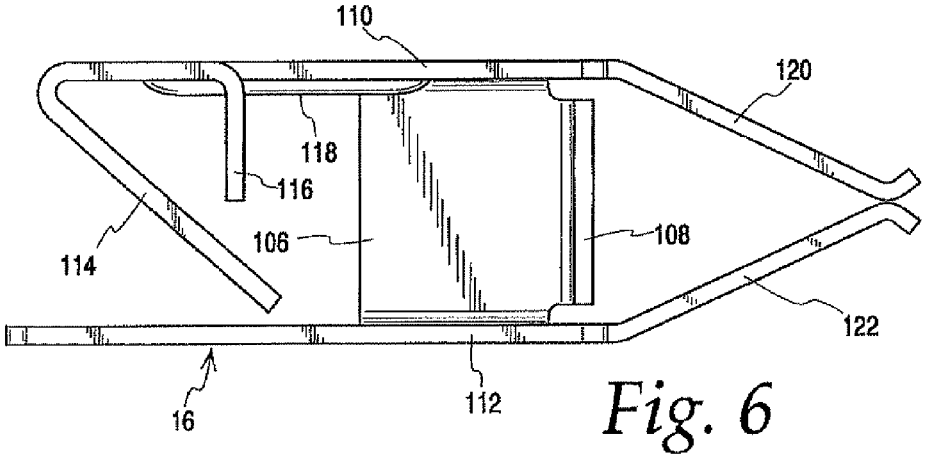
FIG. 6 is a top plan view of the female contact.
Figure 7:
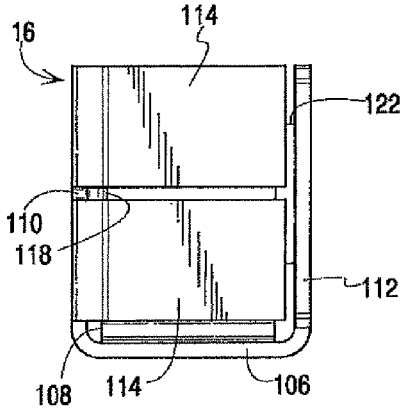
FIG. 7 is a rear elevation view of the female contact.

Turning now to the contacts 16, 20, both contacts are preferably formed as one-piece stampings from a suitable copper alloy such as phosphor bronze 510 spring temper. It will be understood that other electrically conductive materials may be suitable. The stamping is bent and folded to the desired shape. The female contact is shown in FIGS. 6 and 7. It has a small base 106 to which are attached a front plate 108 and first and second side plates 110 and 112. The rear portions of the side plates define push-in connector elements. Side plate 110 has two spring fingers 114 that are folded back toward the side plate 112 at about a 45° angle. As seen in FIG. 7 there is a gap between the spring fingers. Tabs 116 on the top and bottom edges of the side plate 110 limit flexing of the spring fingers toward side plate 110. The side plate 110 may also have a stiffening rib 118. At the front of each side plate 110, 112 there is a pair of flexible receptacle plates. These are shown at 120 and 122. The receptacle plates are angled toward one another as seen in FIG. 6. The ends of the receptacle plates may be flared slightly as shown to provide a lead-in to the female receptacle defined between the receptacle plates.

Figure 9:
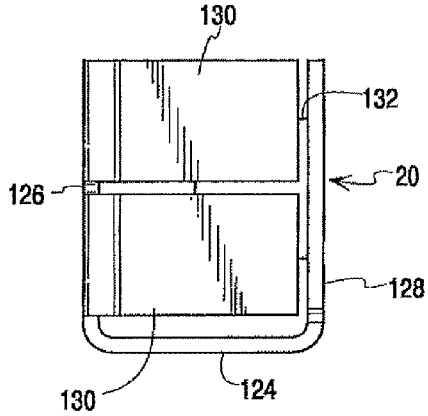
FIG. 9 is a rear elevation view of the male contact.
Figure 8:
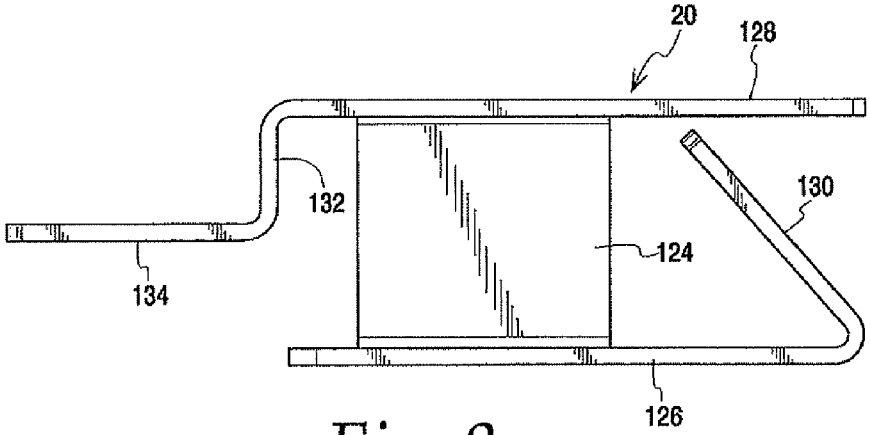
FIG. 8 is a top plan view of the ballast connector male contact.

Male contact 20 is shown in FIGS. 8 and 9. It is similar in many respects to the female contact except for the substitution of a single blade for the twin receptacle plates. Thus, the contact 20 has a base 124 and first and second side plates 126, 128. Again the rear portions of the side plates form push-in connector elements including two spring fingers 130. The second side plate 128 has a tang 132 at the front end. A single male blade 134 extends axially from the tang.

Figure 10:
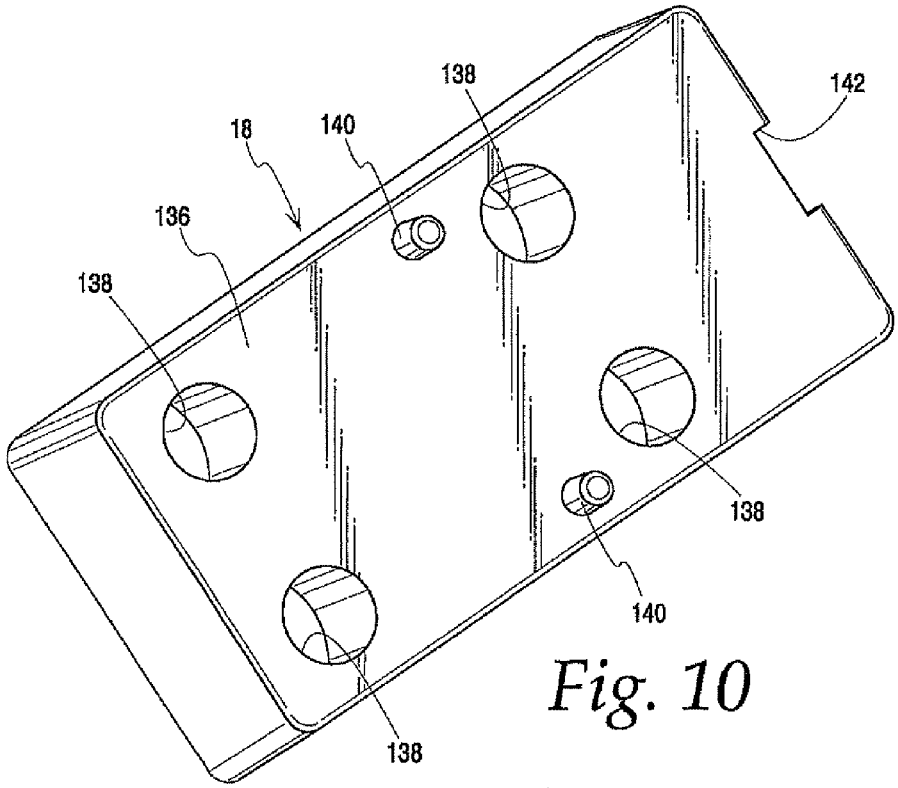
FIG. 10 is a perspective view of the interior side of the power connector retainer.

FIG. 10 shows the power connector retainer 18. It has a block 136 with wire access holes 138 through the block. Although four holes are shown, it will be understood that different numbers of wire access holes could be provided. The inner face of the block has two pegs 140 located so as to align with the seats 70 in partition 68. A channel 142 on one side of the block is sized to receive the rail 74 in the shell 32 of the power connector housing 12.

Figure 11:
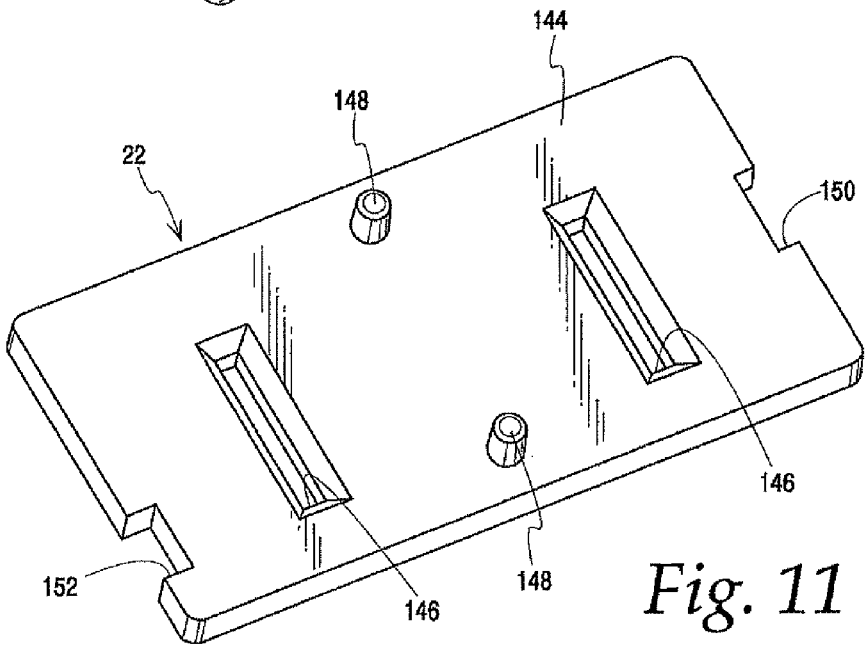
FIG. 11 is a perspective view of the interior side of the ballast connector retainer.
Figure 12:
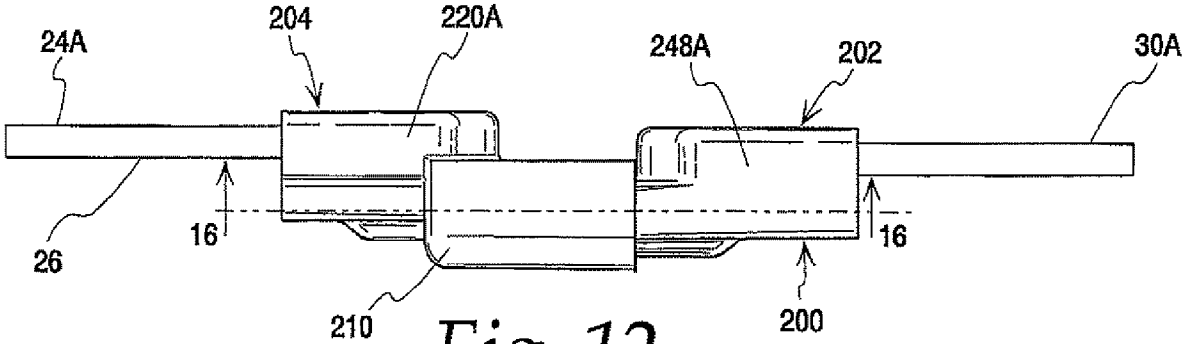
FIG. 12 is a side elevation view of a second embodiment of an electrical disconnect of the present invention.

FIG. 11 illustrates the load connector retainer 22. It has a plate 144 with elongated blade receiving slots 146 through the plate. The inner face of the plate has two pegs 148 located so as to align with the seats 96 in partition 94. A cutout 150 in the side edge allows the plate to clear the key 104 in the load connector housing recess 100. A second cutout 152 accommodates the orienting block 102.

The power connector is assembled as follows. A first female contact 16 is pushed into the compartment 66A of shell 32 with the receptacle plates 120, 122 going in first. Thus, the receptacle ends up adjacent the access opening 56A and the spring fingers 114 are toward the open rear end 40. Then a second female contact is similarly installed into compartment 66B with the receptacle of the contact adjacent access opening 56B. Although the contacts are sized so they can float slightly in their respective compartments, it can be seen that the partition 68 will prevent physical or electrical engagement of the two contacts. With the two contacts in place the power connector retainer 18 is installed by pressing it into the open rear end 40 of the shell 32. The channel 142 clears the rail 74 and provides a polarizing feature that prevents putting the retainer in backwards. The retainer is pressed in until it engages the barrier pads 72. At this point the pegs 140 will fit into the seats 70 of the partition 68. The retainer is fixed in this position by sonic welding or other suitable method. The power connector housing is then complete.

The load connector is assembled as follows. A first male contact 20 is pushed into the compartment 92A of shell 76 with the spring fingers 130 going in first. Thus, the male blade 134 ends up adjacent the open end 86 and the spring fingers 130 are toward the end wall 84. Then a second male contact is similarly installed into compartment 92B with the blade of the contact adjacent open end 86. Although the contacts are sized so they can float slightly in their respective compartments, it can be seen that the partition 94 will prevent physical or electrical engagement of the two contacts. With the two contacts in place the load connector retainer 22 is installed by pressing it into the recess 100 of the shell 76. The male blades 134 will fit through the blade receiving slots 146 of the retainer. The cutout 150 clears the key 104 and provides a polarizing feature that prevents putting the retainer in backwards. The second cutout 152 clears the orienting block 102 in the housing. The retainer is pressed in until it engages the abutments 98. At this point the pegs 148 will fit into the seats 96 of the partition 94. The retainer is fixed in this position by sonic welding or other suitable method. The load connector housing is then complete.

The use, operation and function of the disconnect are as follows. At a first time installation the power wires 24A, 24B are prepared as shown in FIG. 1-*Then* each wire is pushed into the power connector housing. The stripped conductor 28 fits through a wire access hole 138 in retainer 18. It then slides under the spring fingers 114. The fingers flex away from the second side plate 112 to receive the conductor. The resiliency of the fingers urges the conductor into electrical engagement with the second side plate 112. Because any withdrawal of the conductor would tend to make the fingers 114 rotate toward the conductor, the push-in connector elements of the contact are self-locking. Once both wires are thus installed, the power connector is ready for use.

The load wires 30A, 30B are similarly installed into the load connector housing. The conductor is pushed through one of the apertures 88 in the load connector housing 14 and then between the spring fingers 130 and the second side plate 128 of the male contact 20. Once again the fingers 130 flex to receive the conductor but they will not permit withdrawal of the conductor.

With both connectors now joined to their respective wires, the disconnect is ready to be joined. The extension 42 of the power connector housing is pressed into the recess 100 of the load connector housing. The key 104 fits into the keyway 54 allowing the extension to move into the recess. As it does so, the male blades 134 fit through the access openings 56A, 56B in the front of the power connector housing. The blades then enter the space between the receptacle plates 120, 122 spreading them apart to allow the thickness of the blade to fit between plates. The resilience of the plates forces them into solid electrical contact with the blades. At the same time the catches 60 of the latch bars 58 engage the hooks 90A, 90B. The catch slips under the hook to hold the two housings together.

When it is desired to replace the load device, such as a ballast, the user presses down on the ramp surface 64 so the catches 60 will slide under the hooks 90A, 90B and allow the housings to be separated. As the housings separate the blades 134 are withdrawn from the receptacle plates 120. All of the blades release from the female contacts at the same time. The female contacts remain at all times surrounded by the housing 12 so the live contacts are always shielded. The new load device has its own wires that will be connected to a load connector housing as described above. The power connector housing may be replaced, if desired, or the existing power connector housing could be reused with the new load connector housing.

A second embodiment of the electrical disconnect of the present invention is shown at 200 in FIGS. 12-18. This embodiment shows a two-port design for connecting two sets of conductors but it will be understood that the disconnect could be designed for use with a different number of conductors. Disconnect 200 has first and second housings, in this case a male housing 202 and a female housing 204.

Figure 14:
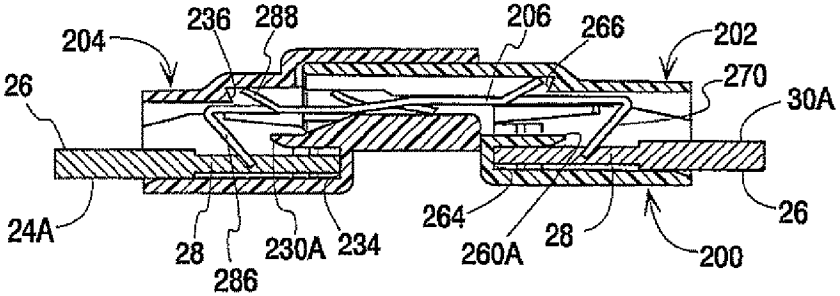
FIG. 14 is a section taken along line 14-14 of FIG. 13.
Figure 15:
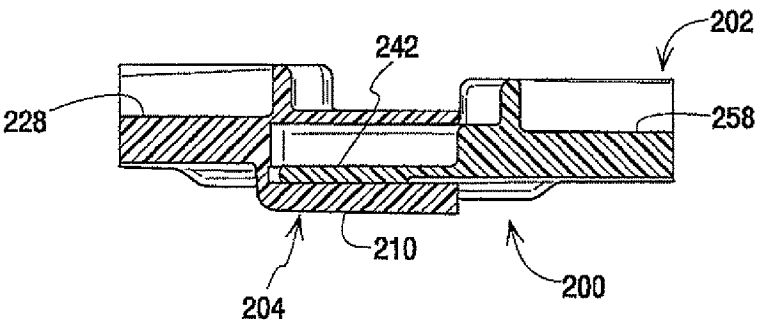
FIG. 15 is a section taken along line 15-15 of FIG. 13.
Figure 16:
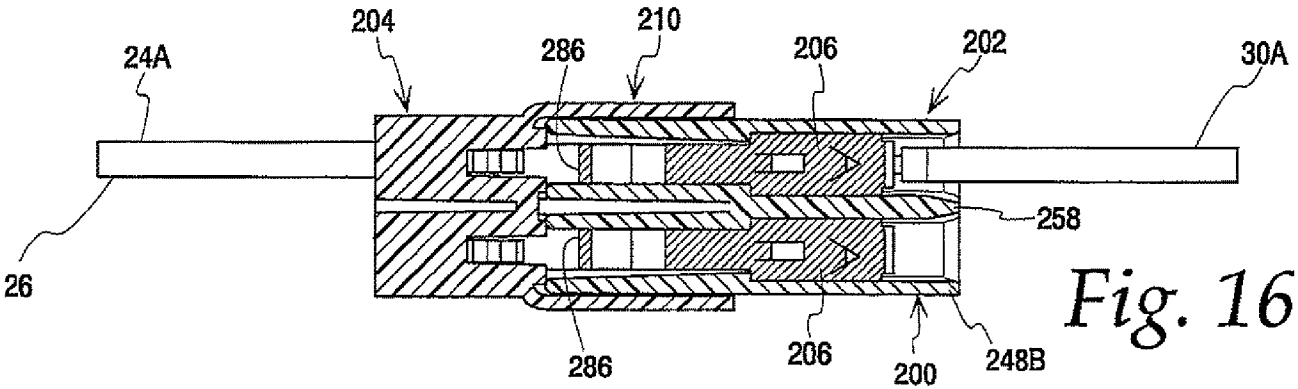
FIG. 16 is a section taken along line 16-16 of FIG. 12.

Inside the male housing 202 there is a pair of male contacts, one of which is shown at 206. Inside the female housing 204 there is a pair of female contacts, one of which is shown at 208. Each of the male and female contacts 206, 208 includes push-in connector elements integrally formed at the rear portions thereof, as will be described below. The designation of the contacts as male and female in this instance derives more from the housing in which they are mounted than any function of the contacts themselves. This is because the contacts engage in a side-by-side relation, rather than one being received within the other. One of the wires connected to the female housing is shown at 24A. The insulation of the wire is shown at 26 and a stripped or exposed conductor portion is shown at 28 (FIG. 14). A wire connected to the male housing is seen at 30A. The wire 24A may extend to a power supply while wire 30A may connect to a ballast or other load device. Alternately, wire 24A may connect to the load while wire 30A connects to the power supply. With the disconnect of the present invention the destinations of the wires is not an issue; either housing may connect to either side of a circuit.

Figure 19:
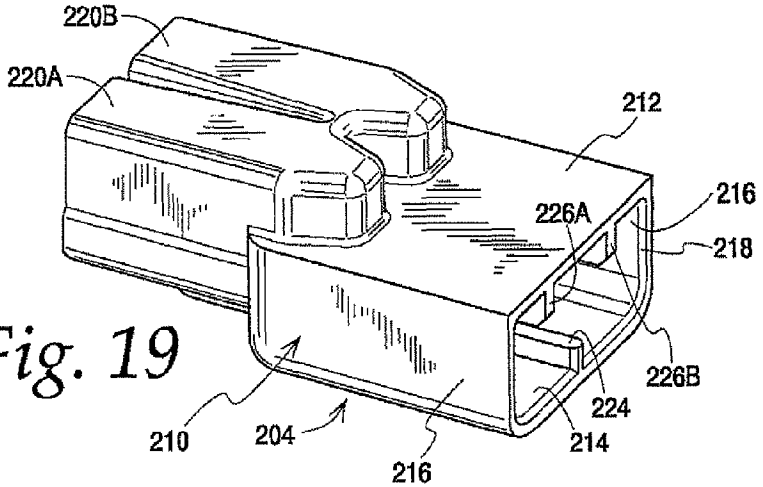
FIG. 19 is a perspective view of the female housing of the disconnect of FIG. 12.
Figure 20:
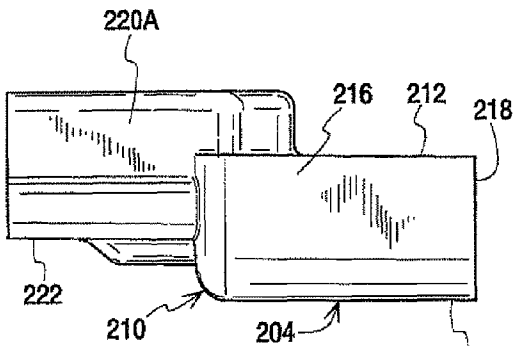
FIG. 20 is a side elevation view of the female housing.
Figure 23:
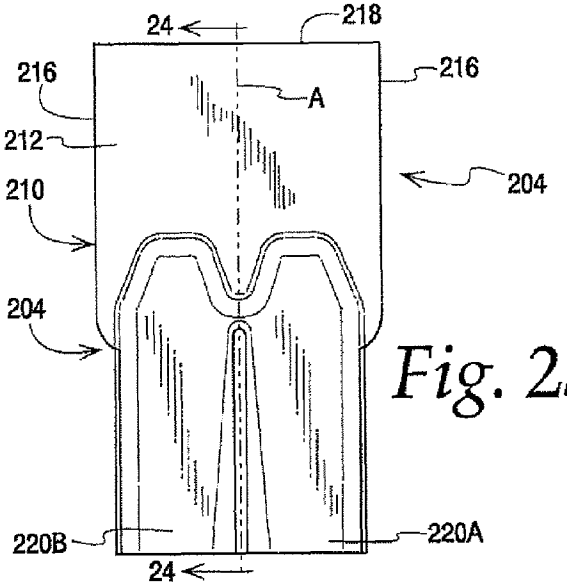
FIG. 23 is a top plan view of the female housing.

Looking at FIGS. 19, 20 and 23, details of the exterior of the female housing 204 are shown. The housing defines a longitudinal axis A as seen in FIG. 23. The housing has a shell 210 defined by a top wall 212 and a bottom wall 214. The top and bottom walls are connected by two side walls 216. The shell has an open front end at 218. The rear half of the shell includes an extension defined by a pair of wire receptacle boxes 220A, 220B and a retainer plate 222. The boxes and retainer plate are offset upwardly from the top wall 212 and bottom wall 214, respectively, as best seen in FIG. 20.

Figure 21:
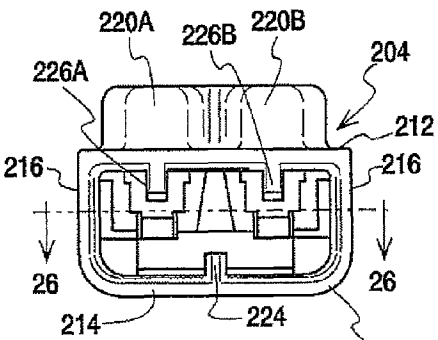
FIG. 21 is a forward end elevation view of the female housing.
Figure 24:
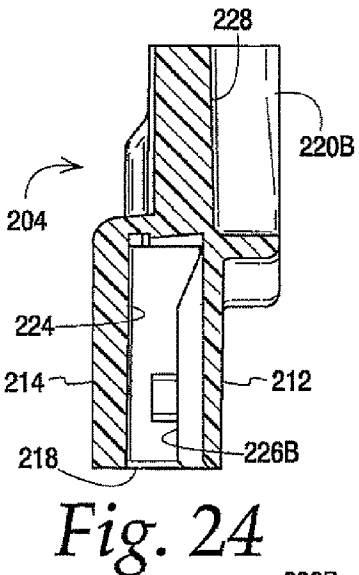
FIG. 24 is a section taken along line 24-24 of FIG. 23.

FIGS. 21 and 24 illustrate the interior features of the shell. There is a longitudinal rib 224 extending upwardly from the bottom wall 214. Two support rails 226A, 226B depend from the top wall 212. As will be explained in more detail below, the support rails engage the support surface of the female contacts 208. The interior of the shell is open to and joins the interior of the extension.

Figure 22:
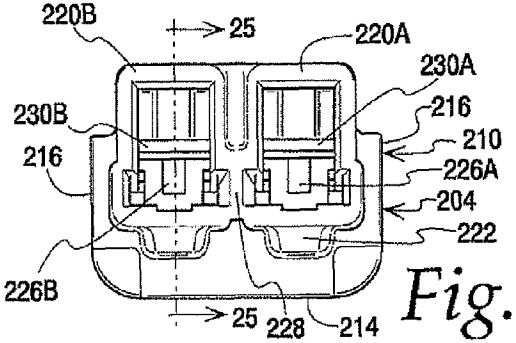
FIG. 22 is a rear end elevation view of the female housing.
Figure 22A:
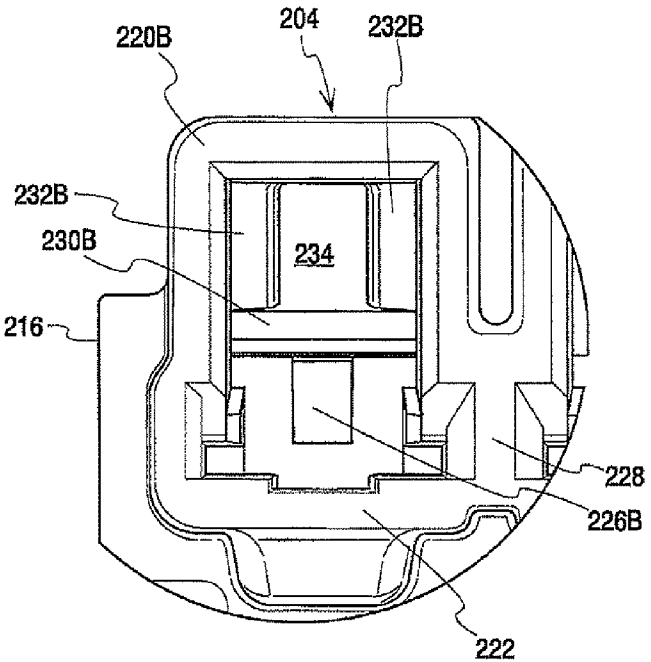
FIG. 22A is an enlargement of a portion of FIG. 22.

FIGS. 22 and 22A illustrate the interior features of the extension. As can be seen in these figures the wire receptacle boxes 220A, 220B are generally three-sided structures the outer walls of which connect to the retainer plate 222 and the inner walls of which merge with one another at a central spine 228. Horizontal guide walls 230A, 230B extend across the interior of the boxes 220A, 220B. The guide walls cooperate with pairs of sloping surfaces 232A, 232B to direct incoming conductors into a seat 234 defined by the wire receptacle boxes and the guide walls. The seat constrains a conductor to a confined area. This is particularly important with stranded conductors because it prevents the conductors from flattening out or splaying, which if it occurred could cause a reduction in the holding force of the push-in connector elements. The guide walls 230A, B have another function and that is to limit deflection of the spring fingers of a contact element. That is, it is desired that the disconnect of this invention be usable with wires ranging in size from 12 AWG to 18 AWG. With the larger wire sizes it may be possible to cause plastic deformation of the spring fingers during insertion of the wire. The guide walls 230A, B are disposed in the path of spring finger movement to limit flexure of the spring fingers to an amount no more than their elastic limit.

Figure 26:
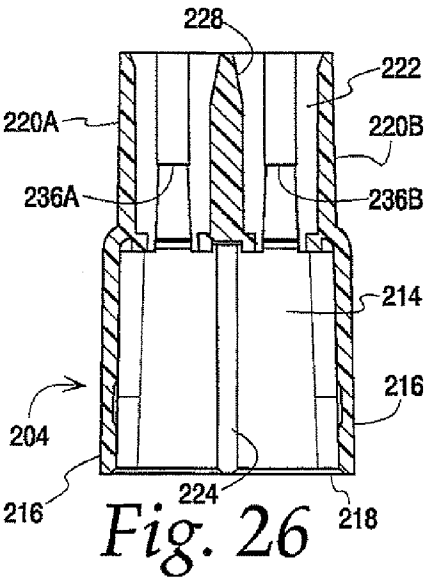
FIG. 26 is a section taken along line 26-26 of FIG. 21.
Figure 25:
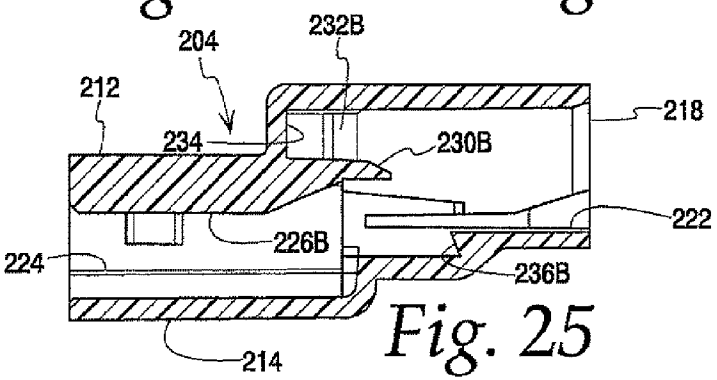
FIG. 25 is a section taken along line 25-25 of FIG. 22.

The retainer plate 222 is best seen in FIGS. 25 and 26. This plate closes the bottom side of the shell's extension. It also serves to lock the electrical contacts within the housing. The structures primarily responsible for this retaining function are the notches 236A, 236B. As will be explained in connection with the assembly drawings of FIGS. 12-18, the notches engage a tab of the contacts to prevent the contacts from being pulled out of the housing. Incorporation of the retainer plate in the interior of the housing alleviates the need to provide a separate cap or cover for closing the housing and holding the contacts therein. Also, it will be noted that the retainer plate is offset from the bottom wall 214. This affords an overall reduction in the volume of the housing, making it more usable in tight quarters.

Figure 27:
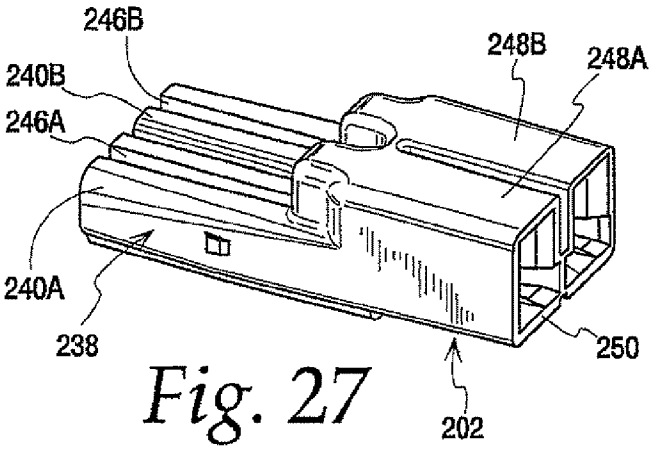
FIG. 27 is a perspective view of the male housing of the disconnect of FIG. 12.
Figure 28:
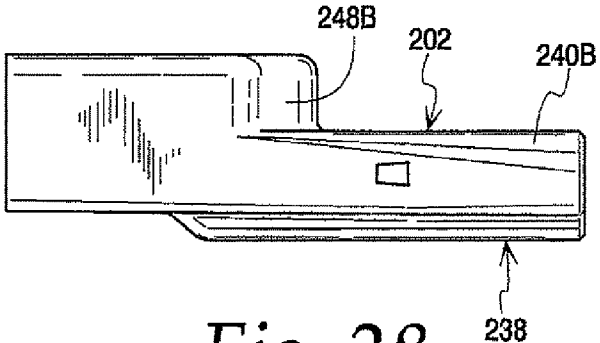
FIG. 28 is a side elevation view of the male housing.
Figure 31:
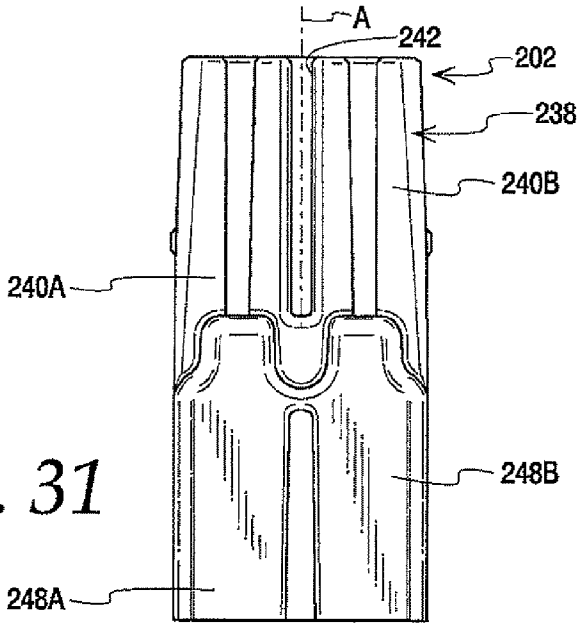
FIG. 31 is a top plan view of the male housing.

Turning now to the male housing 202, FIGS. 27, 28 and 31 show the exterior features thereof. The housing 202 defines a longitudinal axis A as seen in FIG. 31. As is the case with female housing, the male housing has a shell 238 at its forward portion. However, the male shell is defined by a pair of generally four-sided compartments 240A, 240B. The compartments are joined near their lower, inside corners by a web 242. A groove 244 (FIG. 29) is defined underneath the web and between the compartments. Slots 246A, 246B are cut in the upper walls of the compartments. The exterior height of the compartments and their combined widths are such that the male shell 238 can be received in the female shell 210. The rear half of the shell has a pair of wire receptacle boxes 248A, 248B and a retainer plate 250.

Figure 29:
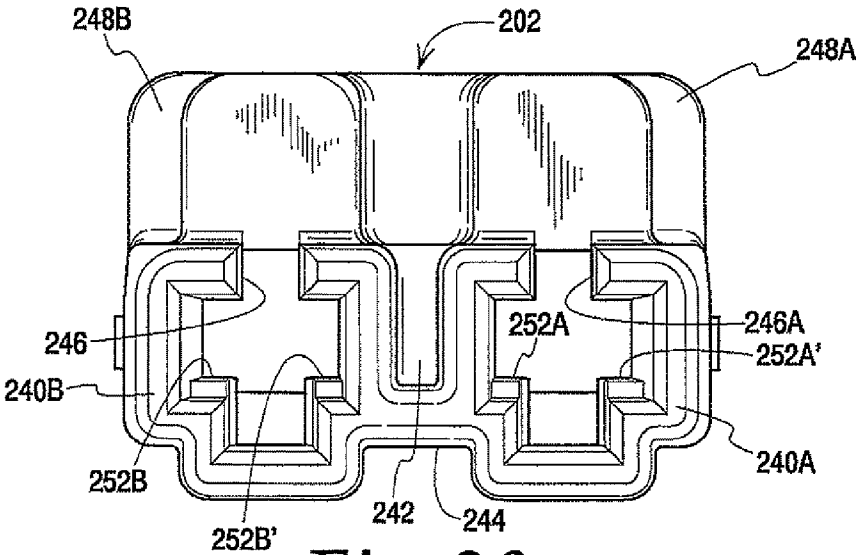
FIG. 29 is a forward end elevation view of the male housing, on an enlarged scale.
Figure 32:
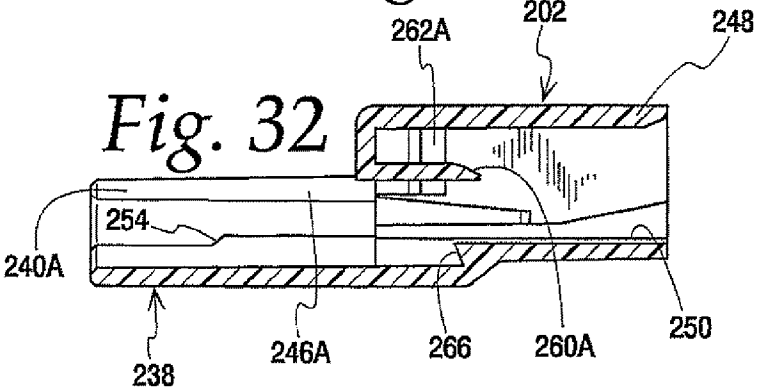
FIG. 32 is a section taken along line 32-32 of FIG. 30.

FIGS. 29 and 32 illustrate the interior features of the shell 238. At the lower interior corners each compartment 240A, 240B has a pair of support rails. One pair of support rails is shown at 252A, 252A' and the other pair of support rails is shown at 252B, 252B'. Each support rail has a short step 254 which gives the rails a greater height at the interior of the shell compared to the front end. As will be explained in more detail below, the support rails engage lateral edges of the support surface of the male contacts 206. The interior of the shell is open to and joins the interior of the extension.

Figure 30A:
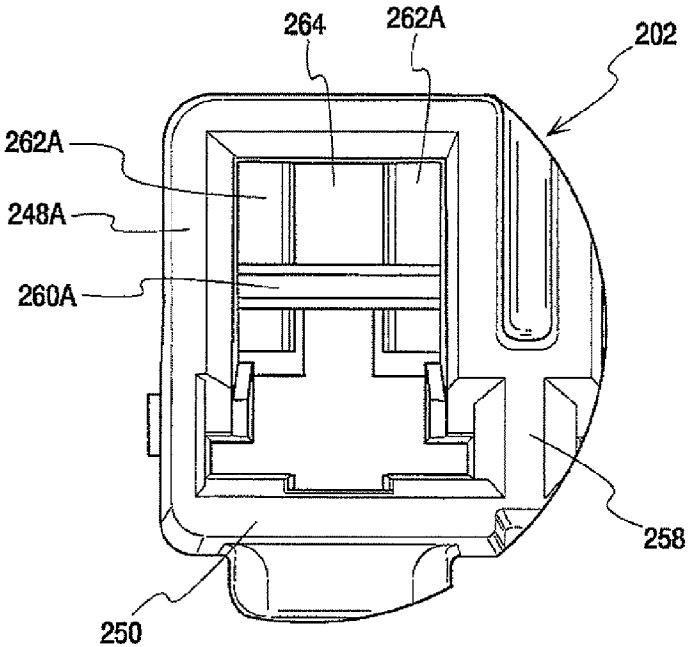
FIG. 30A is an enlargement of a portion of FIG. 30.
Figure 30:
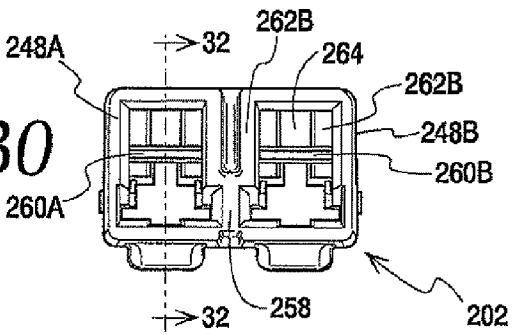
FIG. 30 is a rear end elevation view of the male housing.

FIGS. 30 and 30A illustrate the interior features of the wire receptacle boxes 248A, 248B. As in the female housing the wire receptacle boxes 248A, 248B are generally three-sided structures. The outer walls of the boxes connect to a retainer plate 250 and the inner walls of the boxes merge with one another at a central spine 258. Horizontal guide walls 260A, 260B extend across the interior of the boxes 248A, 248B. The guide walls cooperate with pairs of sloping surfaces 262A, 262B to direct incoming conductors into a seat 264 defined by the wire receptacle boxes and the guide walls. The seat 264 has the same purpose as seat 234 in the female housing. The guide walls 260A, B also perform the spring finger flexure limiting function of the guide walls 230A, B.

The retainer plate 250 is best seen in FIG. 32. This plate closes the bottom side of the wire receptacle boxes. It also has a pair of notches, one of which is visible at 266. As in the female housing, the notches lock the male electrical contacts within the housing.

FIGS. 33-36 illustrate details of the male contacts 206. Each contact is made of a suitable, electrically conductive material. Preferably the material is a 510, 511 or 519 phosphorous bronze spring temper, having a thickness of about 0.016 ∀ 0.002 inches. The contact has a central plate 268. At the outer end of the plate the contact has a spring finger 270 folded back on the plate at an angle of about 39° to 43°. An angle of 41° is preferred to make the spring finger work with a range of wire sizes. The spring finger serves as a push-in connector element that mechanically and electrically engages a conductor pushed into the housing. First and second tabs 272, 274 are formed in the central plate and extend downwardly therefrom. At the inner end of the plate 268 there is an arm 276. The arm has a support surface 278 and a mating surface 280 on the opposite side from the support surface. A rounded dimple 282 is formed at or near the outer end of the arm 276.

FIGS. 37-40 illustrate details of the female contacts 208. Again, each contact is preferably made of a 510, 511 or 519 phosphorous bronze spring temper, having a thickness of about 0.016 ∀ 0.002 inches. The contact has a central plate 284. At the outer end of the plate the contact has a spring finger 286 folded back on the plate at an angle of about 39° to 43°. An angle of 41° is preferred to make the spring finger work with a range of wire sizes. A single tab 288 is formed in the central plate and extends downwardly therefrom. An arm 290 extends from the inner end of the plate 284. The arm has a support surface 292 and a mating surface 294 on the opposite side from the support surface. A rounded dimple 296 is formed at or near the outer end of the arm 290. It has been found that the particular material, thickness and spring finger angle permits the contact to work reliably with a range of wire sizes and types. Specifically, wires sizes from 12 AWG to 18 AWG and either stranded or solid conductors can be reliably held with the contact arranged as described.

Figure 18:
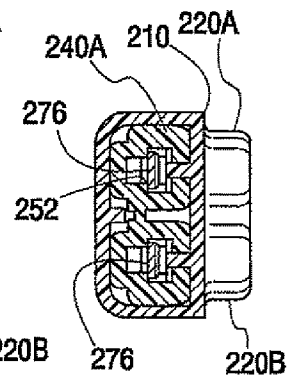
FIG. 18 is a section taken along line 18-18 of FIG. 13.
Figure 17:
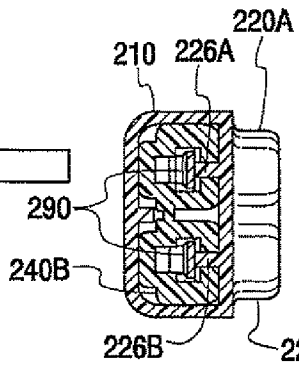
FIG. 17 is a section taken along line 17-17 of FIG. 13.
Figure 13:
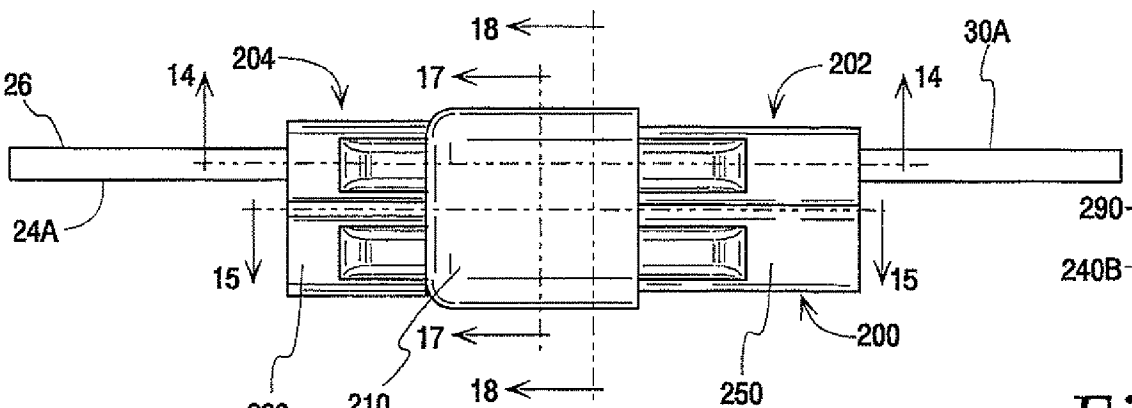
FIG. 13 is a bottom plan view of the electrical disconnect of FIG. 12.

Having described the individual components of the disconnect, attention can now be focused on FIGS. 12-18. Assembly of the disconnect is as follows. Male contacts 206 are pushed into the male housing 202 through the openings at rear end of the wire receptacle boxes 248A, 248B. The first contact is arranged so that the lateral edges of its support surface 278 are adjacent to and supported by the support rails 252A, 252A'. Similarly, the second contact is arranged so that the lateral edges of its support surface 278 are adjacent to and supported by the support rails 252B, 252B'. This is best seen in FIGS. 17 and 18. As the contacts are inserted the first tab 272 will snap past the notch 266 as seen in FIG. 14. The second tab will engage the plastic material of the retainer plate. The engagement of the tabs with the retainer plate prevents the contacts from pulling out of the housing, even though there is no cap or plate at the entry to the wire receptacle boxes. It will be noted that when the male contacts are fully inserted the forward edge of the dimple rests on one side of the step 254 while the rear edge of the dimple rests on the other side of the step. The recess defined by the step affords some space into which the dimple can flex during connection of the two housings. Installation of the female contacts 204 is similar except there is only one tab 288 that snaps past one of the notches 236A or 236B. Once this is done the disconnect is ready for use. No cap or cover is necessary, which reduces the number of parts and therefore the cost of the disconnect.

The use, operation and function of the disconnect are as follows. Stripped wires 24 are pushed into the female housing. The stripped conductor 28 fits through the open rear end of the wire receptacle boxes 220A, 220B. It then slides under the spring finger 286 of one of the female contacts 204. The fingers flex toward the central plate 284 to receive the conductor. The resiliency of the fingers urges the conductor into electrical engagement with the finger. Because any withdrawal of the conductor would tend to make the fingers 286 rotate toward the conductor, the push-in connector elements of the contact are self-locking. The ends of the conductors are guided into the seat 234 by the guide walls 230A, 230B and the sloping surfaces 232A, 232B. The seat 234 fixes the location of the conductor and prevents it from moving around in the receptacle boxes as the external portion of the wire is handled. Once both wires are thus installed, the female housing is ready for use.

Stripped wires 30 are similarly installed into the male housing 202. The conductor is pushed through the open end of the wire receptacle boxes 248A, 248B and then under the spring fingers 270. Once again the spring fingers 270 flex to receive the conductor but they will not permit withdrawal of the conductor. The end of the conductor slides into the seat 264 as directed by the guide walls 260 and sloping surfaces 262.

With both housings now fitted to their respective wires, the disconnect is ready to be joined. The shell 238 of the male housing 202 is pressed into the open end 218 of the female housing shell 210. The rib 224 fits into the groove 244 allowing the shell to move into the recess of the female shell. As it does so, the support rails 226A, 226B of the female housing fit into the slots 246A, 246B in the top of the male housing. The mating surfaces of the contacts slide past one another until the dimples contact one another. Continued movement of the housings causes the dimples to flex. Once they are past one another they return to their natural condition where they assist in holding the housings together. The resilience of the contacts forces their mating surfaces 280 and 294 into solid electrical contact with the blades. The support rails are arranged to maintain physical engagement with the most of the arm portions of the contacts. This assures the contacts can not flex away from solid engagement with one another despite the contacts being surrounded by the male and female shells.

When it is desired to replace the load device, such as a ballast, the user can cause the housings to be separated by pulling them apart. As the housings separate the male contacts 206 are withdrawn from the female housing and engagement with the female contacts 204. All of the male contacts release from the female contacts at the same time. Also, all of the contacts remain at all times surrounded by their respective housings so no matter which way the disconnect is wired, the live contacts are always shielded.

Figure 41A:
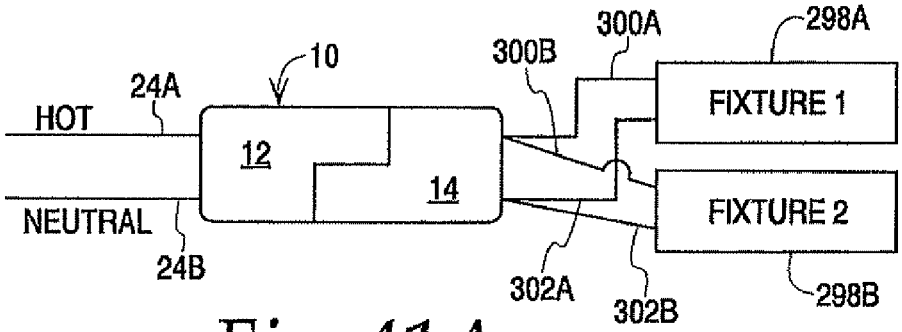
FIGS. 41A and 41B are circuit diagrams showing one possible application of the disconnect of FIGS. 1-12.
Figure 41B:
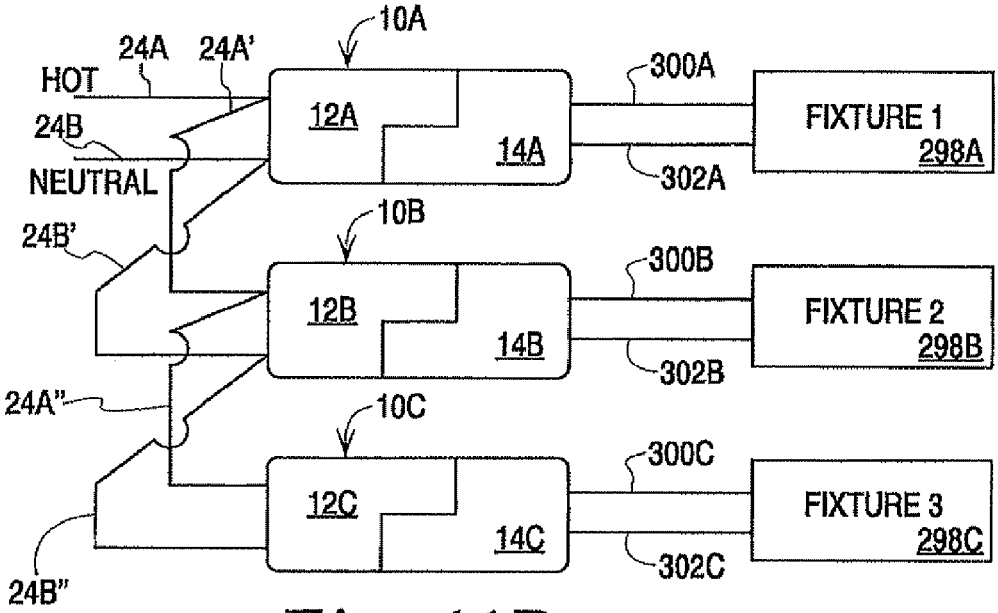

FIGS. 41A and 41B illustrate one possible application of the disconnect of FIGS. 1-11. Since each of the contacts 16 and 20 has a pair of spring fingers, more than one wire can be attached to a particular contact. This permits so-called daisy-chaining of conductors. That is, a single load connector housing 14 could supply hot and neutral to multiple fixtures 298A, 298B, as seen in FIG. 41A. Pairs of hot wires 300A, 300B extend from the hot side of load connector housing 14 to fixture 298A, 29813, respectively. Similarly, a pair of neutral wires 302A, 302B extend from the neutral side of load connector housing 14 to fixture 298A, 298B, respectively. In an alternate arrangement, a single hot and neutral supply could be connected from a first disconnect 10A to a second disconnect 10B, as shown in FIG. 41B. The daisy chain could continue to a third disconnect 10C, or however many might be needed by a particular application. Each of the disconnects in FIG. 41B supplies its own fixture 298A, B and C. In the arrangement of FIG. 41B, two conductors 24B, 24B' would be connected to a single contact, such as contact 16. As seen in FIG. 11 there are two wire ports opposite the two spring fingers 114. This accommodates the two wires 24B, 24B'. One wire goes to the hot supply, the other goes to one side of the second disconnect 10B. Similarly, two conductors 24A, 24A' would be connected to the second contact in the load side housing 12A. One such wire goes to the neutral supply, the other goes to the neutral side of the second disconnect 10B. Conductors 24A" and 24B" similarly connect disconnect 10B to disconnect 10C. Hot and neutral wires 300A, 30013 join disconnect 10A to fixture 298A. Similar connections are made to fixtures 298B, 298C. It can be seen that the daisy chain arrangements of FIGS. 41A and 41B could be combined so that both sides of the disconnect are daisy chained. The dual spring finger of contacts 16 and 20 makes daisy chaining possible. If only a single spring finger is available it cannot reliably retain two separate conductors.

While the preferred form of the invention has been shown and described herein, it should be realized that there may be many modifications, substitutions and alterations thereto. For example, while the disconnect is shown and described with two contacts, different numbers of contacts could be used. The housings could be other than as shown, e.g., the retainer plate could be incorporated into the housing or the housing could be split longitudinally into two halves that are joined together. The contacts could have numerous alternate configurations to provide the push-in elements and plug and socket combination. Hermaphroditic contacts could be substituted for the male blade and female receptacle shown.

We claim:

1. An electrical disconnect, comprising:

first and second connector housings defining a longitudinal axis along which the housings are movable to engage and disengage one another;

at least one of the housings including one or more housing walls defining a hollow portion, and at least one of the housing walls including a raised surface portion;

an electrical contact within the hollow portion of the housing, the contact having a raised surface portion for engagement with the raised surface portion of the housing wall;

a counterpart electrical contact in the other of the first and second housings;

the contact of the one of the housings having a portion which is releasably electrically engageable with a portion of the counterpart contact in the other of the first and second housings; and at least one of the contacts having a portion which includes push-in connector elements which are electrically engageable with at least one electrical wire when the wire is inserted into the housing.

2. The electrical disconnect of claim 1 wherein the push-in connector elements are mechanically engageable with the at least one electrical wire when the wire is inserted into the housing to retain the wire in the housing.

3. The electrical disconnect of claim 1 wherein the raised surface portion of the housing wall is defined by a notch.

4. The electrical disconnect of claim 1 wherein the at least one housing wall that includes a raised surface portion is a bottom wall.

5. The electrical disconnect of claim 1 wherein each housing includes a first portion facing the other housing and a second portion opposite the first portion, and a contact-receiving opening is formed in one of the first or second portions of the housing.

6. The electrical disconnect of claim 1 wherein the raised surface portion of the contact is defined by a tab.

* * * * *